US005304078A

United States Patent [19]

Kaneko

[11] Patent Number: 5,304,078

[45] Date of Patent: Apr. 19, 1994

[54] REVERSE THRUST BUCKET FOR JET DEVICE

[75] Inventor: Yoshiyuki Kaneko, Iwata, Japan

[73] Assignee: Yamaha Hatsudoki Kabushiki Kaisha, Iwata, Japan

[21] Appl. No.: 909,621

[22] Filed: Jul. 7, 1992

[30] Foreign Application Priority Data

Jul. 15, 1991 [JP] Japan ..... 3-173922

[51] Int. Cl.[5] ..... B63H 11/11

[52] U.S. Cl. ..... 440/41; 440/42

[58] Field of Search ..... 440/41, 42, 40; 60/222

[56] References Cited

U.S. PATENT DOCUMENTS

| | | | |
|---|---|---|---|
| 3,064,420 | 11/1962 | Goehler | 440/41 X |
| 3,336,752 | 8/1967 | Smith | 440/41 X |
| 3,422,788 | 1/1969 | Horan, Jr. | 440/41 |
| 3,782,320 | 1/1974 | Groves, Jr. | 440/41 X |
| 3,797,447 | 3/1974 | Stubblefield | 440/41 X |
| 3,901,176 | 8/1975 | Copp et al. | 440/41 |
| 3,949,700 | 4/1976 | Baroody | 440/41 |
| 5,049,096 | 9/1991 | Henn | 440/42 X |

FOREIGN PATENT DOCUMENTS

| | | | |
|---|---|---|---|
| 4-020172 | 1/1991 | Japan | 440/42 |

*Primary Examiner*—Sherman Basinger

*Attorney, Agent, or Firm*—Knobbe, Martens, Olson & Bear

[57] ABSTRACT

A reverse thrust bucket assembly for a water jet propulsion unit wherein the reverse thrust bucket and the discharge nozzle are configured to provide a good seal in the reverse thrust position of the reverse thrust bucket while, at the same time, permitting the reverse thrust bucket flow directing surface to have an uninterrupted curved area without an offset sealing flange that could offer flow resistance when being shifted between its positions. In addition, the steering nozzle and discharge end of the jet propulsion unit are configured so as to preclude any leakage in this area.

30 Claims, 4 Drawing Sheets

REVERSE THRUST BUCKET FOR JET DEVICE

BACKGROUND OF THE INVENTION

This invention relates to a reverse thrust bucket for a jet drive and more particularly to a reverse thrust arrangement for a water jet propulsion unit.

Water jet propulsion units have a number of advantages over more conventional propeller type watercraft. In order to operate in reverse direction, it has been the practice to provide a reverse thrust bucket that is mounted on the discharge end of the jet propulsion unit for movement between a normal forward drive position and a reverse drive position. In the reverse drive position, the reverse thrust bucket redirects the flow of water from the jet propulsion unit discharge into a forward direction for generating a reverse driving thrust.

Generally these reverse thrust buckets include a surface that is adapted to be brought into confronting relationship with the discharge opening of the discharge nozzle for redirecting the water flow. It is important that the reverse thrust bucket establish a good sealing relationship with the discharge nozzle when in the reverse thrust position so as to improve the operating efficiency of the jet drive. To achieve this, it has been the practice to provide an offset flange at the surface of the reverse thrust bucket that is adjacent the upper end of the discharge nozzle when the reverse thrust bucket is in its reverse drive position. As a result, the surface of the reverse thrust bucket has a first portion that achieves the reverse thrust operation and a second, angularly related portion, that achieves the seal.

However, this angularly related portion provides not only drag when operating in the forward drive mode, but also generates a force that resists the movement of the reverse thrust bucket between its forward drive position and its reverse drive position. This gives rise to the necessity of employing considerable force on the reverse thrust bucket to move it between its positions.

It is, therefore, a principal object of this invention to provide an improved reverse thrust arrangement for a water jet propulsion unit.

It is a further object of this invention to provide an improved reverse thrust bucket and discharge nozzle arrangement for a water jet propulsion unit that will achieve good sealing in the reverse thrust mode while, at the same time, providing minimum flow resistance when operating in a forward mode.

It is a further object of this invention to provide an improved sealing arrangement for a reverse thrust bucket that will not provide any flow resistance or significant resistance to movement of the reverse thrust bucket between its positions so as to permit ease of operation.

SUMMARY OF THE INVENTION

This invention is adapted to be embodied in a reverse thrust arrangement for a water jet propulsion unit comprising a discharge nozzle having a discharge opening through which water from the jet propulsion unit is discharged. A reverse thrust bucket is supported for movement relative to the discharge nozzle between a forward drive position generally above the discharge opening wherein the flow of water through the discharge opening is substantially unobstructed for establishing a forward drive mode and a reverse drive position wherein the water flowing from the discharge opening is redirected for generating a reverse drive thrust. The reverse thrust bucket is defined by a first portion having a generally arcuate surface adapted to be brought into facing relationship with the discharge opening of the discharge nozzle for reversing the direction of flow of water therefrom. The reverse thrust bucket also has a pair of side surfaces that extend along opposite sides of the discharge nozzle. The first portion and the side surfaces of the reverse thrust bucket form an opening through which water may flow without obstruction when the reverse thrust bucket is in its forward thrust position. Means are provided on the discharge nozzle for sealingly engaging means on the reverse thrust bucket when the reverse thrust bucket is in its reverse position for precluding the escape of water upwardly past the reverse thrust bucket when operating in the reverse mode.

DETAILED DESCRIPTION OF THE PREFERRED EMBODIMENT OF THE INVENTION

Figure 1:
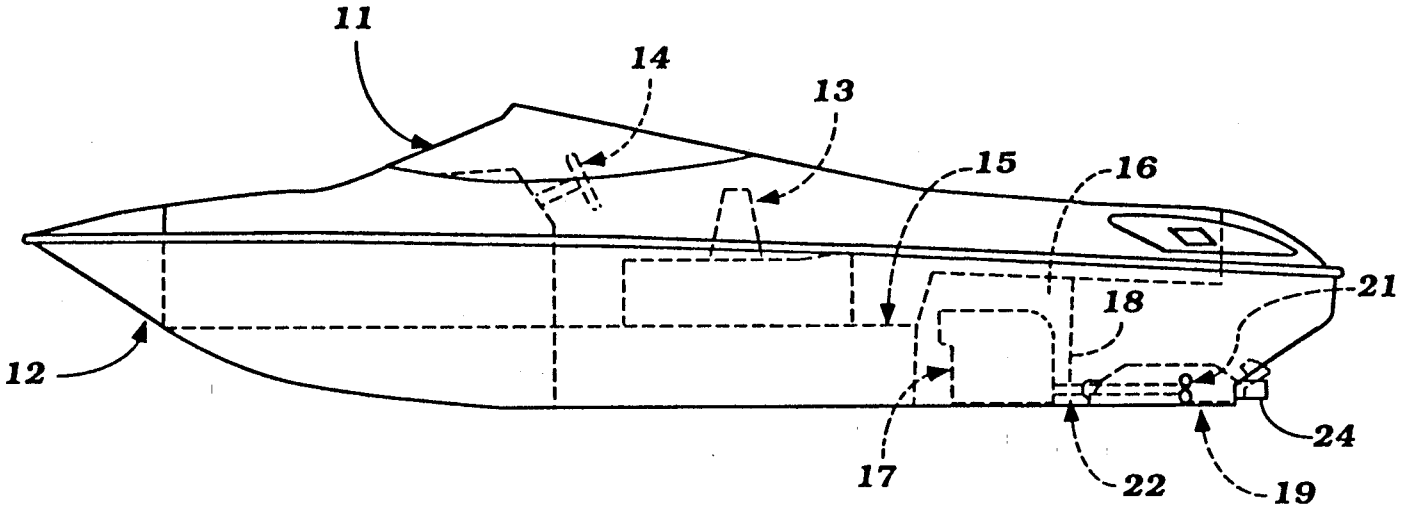
FIG. 1 is a side elevational view of a jet propelled watercraft employing reverse thrust buckets constructed in accordance with an embodiment of the invention.
Figure 2:
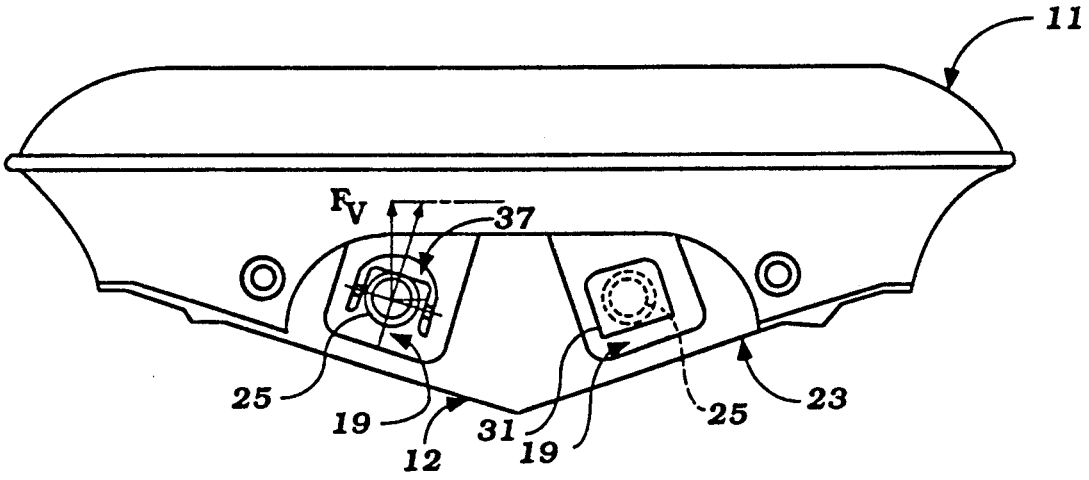
FIG. 2 is a rear elevational view of the watercraft.

Referring first to FIGS. 1 and 2, a watercraft powered by a pair of jet propulsion units incorporating reverse thrust buckets constructed in accordance with an embodiment of the invention is identified generally by the reference numeral 11. The watercraft illustrated is only one of many types of watercraft in which the invention may be employed, but is depicted for exemplary purposes. The watercraft 11 includes a hull 12 which defines a passenger compartment 13 in which one or more riders are adapted to be accommodated. A portion of the passenger compartment 13 accommodates the operator and a steering wheel 14 and other watercraft controls are positioned forwardly of this operator's position.

The hull 12 defines a floor area 15 which is positioned forwardly and partially above an engine compartment 16 in which a pair of engines 17 are supported in a suitable manner. In the illustrated embodiment, the watercraft 11 has twin propulsion units and hence, there are provided a pair of engine compartments 16 or a common engine compartment in which two engines 17 are positioned.

A tunnel is at least partially formed to the rear of the engine compartment 16 and is defined in part by a vertically extending bulkhead. A pair of jet propulsion units, indicated generally by the reference numeral 19, and having impellers 21 driven by a driveshaft 22 of the respective engine 17 is positioned in this tunnel.

As may be best seen in FIG. 2, the hull 12 has a V-bottom 23 and in accordance with a feature of the invention, the jet propulsion units 19 are disposed so that their lower surfaces extend generally parallel to the V-bottom 23, which provides an operational feature which will be described later.

Figure 3:
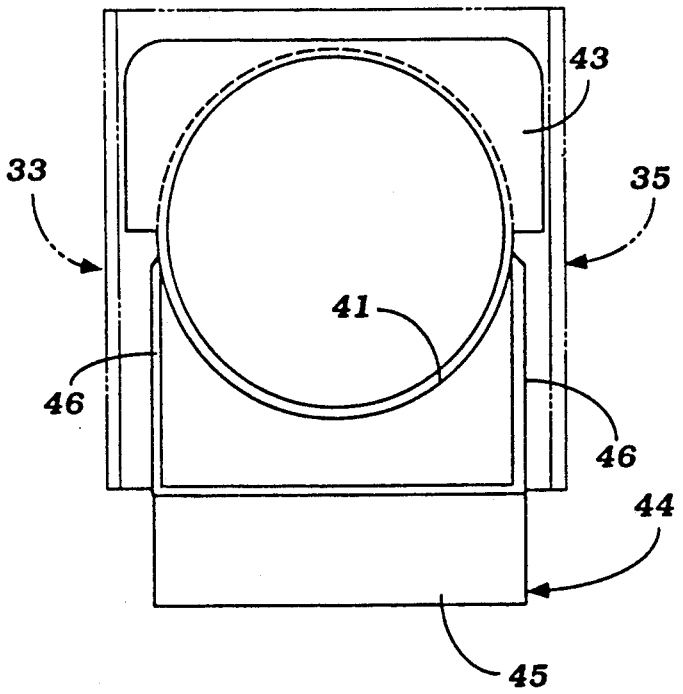
FIG. 3 is an enlarged rear elevational view of the discharge nozzle portion of the jet propulsion units.
Figure 4:
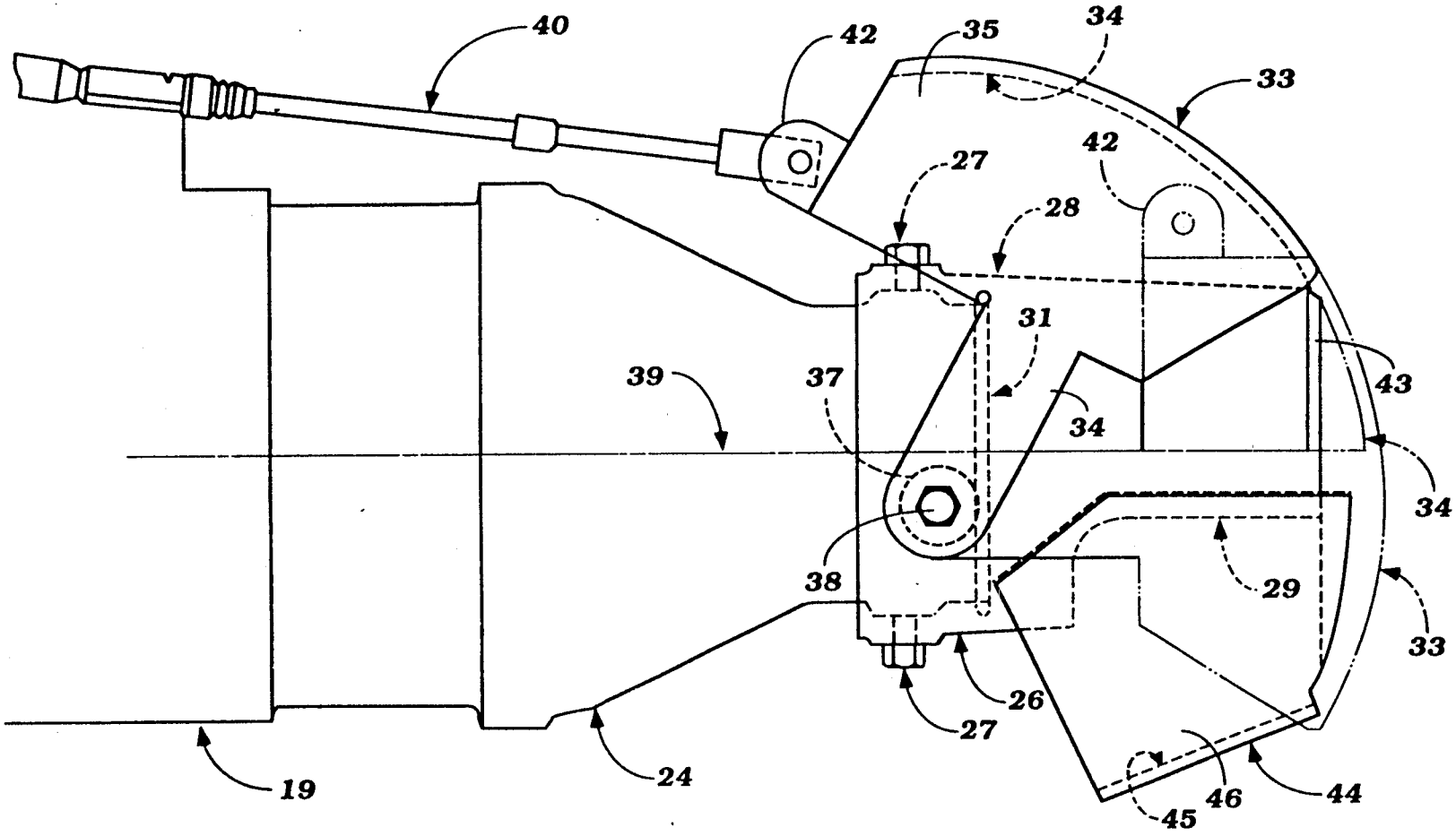
FIG. 4 is an enlarged cross-sectional view of the discharge end of one of the jet propulsion units.
Figure 5:
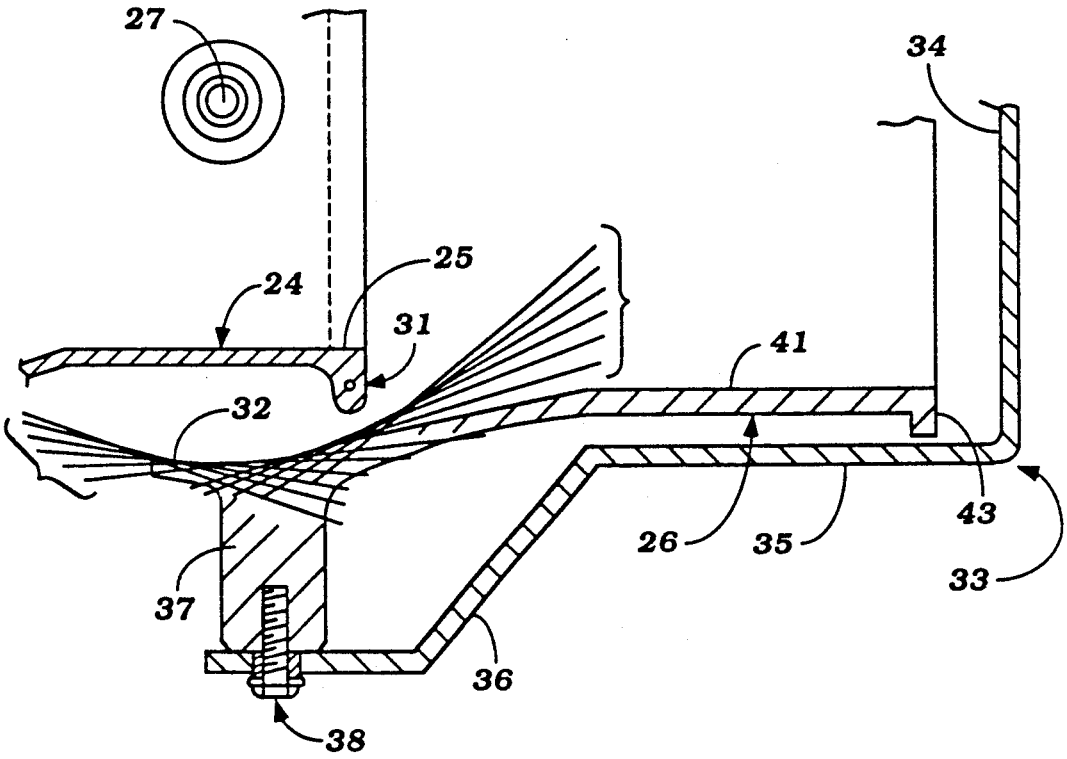
FIG. 5 is a cross-sectional view, on an enlarged scale, taken generally along a horizontally extending plane through the pivotal support of the reverse thrust bucket and showing the reverse thrust bucket in its reverse thrust condition.

The construction of the jet propulsion units 19 may be considered to be conventional, except for the steering and reverse thrust arrangement which will now be described in more detail by particular reference to FIGS. 3-5. The construction and operation of any portion of the jet propulsion units 19 which is not described in detail may be considered to be conventional.

As is known, the impeller 21 draws water through a downwardly facing water inlet and then discharges it rearwardly. This water is discharged through a discharge nozzle 24 which is formed integrally with the outer housing of the jet propulsion unit 19 and which has a convergent section across which a rearwardly facing discharge opening 25 extends.

A steering nozzle 26 is supported for steering movement by the discharge nozzle 24 adjacent the discharge opening 25 by a pair of vertically extending pivot pins 27. Because of the angular disposition of the jet propulsion units 19 as shown in FIG. 2, the axes defined by the pivot pins 27 extend perpendicularly to the V-bottom hull 23 rather than purely vertically. The significance of this will become apparent.

The steering nozzle 26 has a generally cylindrical portion 28 which, in turn, terminates in a discharge opening. In accordance with a feature of the invention, a part of the cylindrical portion 28 is cut away, as at 29, so as to form a downwardly facing open area.

The discharge opening 25 of the discharge nozzle 24 is surrounded by an outwardly extending flange 31. The steering nozzle 26 has a generally curved configuration, as shown at 32 in FIG. 5, which is juxtaposed to the flange 31 and which is configured so as to permit a close fit between the inner periphery of the steering nozzle 26 defined by the curved area 33 and the flange 31 so as to ensure a relatively water-tight area so as to preclude any water leakage between the steering nozzle 26 and the flange 31 that could adversely affect performance.

A reverse thrust bucket 33 is mounted, in a manner to be described, on the steering nozzle 26 so as to provide a reverse thrust operation. The reverse thrust bucket 33 includes a rear wall member that defines a generally arcuate surface 34, having a curvature which will be described. A pair of side portions 35 extend from this curved wall 34 and terminate in extending lugs 36 which provide a pivotal connection to a pair of bosses 37 formed on the steering nozzle 26 by means of pivot bolts 38. It should be noted that the pivotal axis defined by the pivot bolts 38 is disposed below an axis 39 which is coincident with a central discharge opening 41 of the steering nozzle 26. It should be noted that the curvature of the surface 34 is about this pivot axis so that the curved surface 36 is closely adjacent the end of the steering nozzle portion 28.

A lug 42 is formed on one of the side portions 35 of the reverse thrust bucket 33 and is connected by means of a Bowden wire 40 to a reverse lever mounted in the passenger compartment 13 adjacent the steering wheel 14. The Bowden wire 40 is adapted to pivot the reverse thrust bucket 33 from its forward drive position, as shown in the solid line view of FIG. 4, to its reverse thrust position as shown in the phantom line view of FIG. 4 and the solid line view of FIG. 5.

It should be noted that in the forward drive position, the upper peripheral edge of the curved surface 34 is above the end of the steering nozzle portion 28 but closely positioned to it. Also, it should be noted that the forward or leading edge of the curved surface 34 in this position faces generally forwardly and is unobstructed between the side walls 35 of the reverse thrust bucket 33. As a result, when the reverse thrust bucket 33 is pivoted toward its reverse thrust position, water can flow easily through this opening, across the curved surface 34 and downwardly so as to avoid any water forces tending to resist the pivotal movement of the reverse thrust bucket 34. Also, it should be noted that the end of the steering nozzle 28 is provided with an outwardly extending flange portion 43 which is adapted to sealingly engage the peripheral edge of the curved surface 34 when the reverse thrust bucket is in its reverse thrust position and thus, water leakage when in this position will be precluded. The configuration of the flange 43 may be best understood by reference to FIGS. 3 and 4.

There is provided a further fixed reverse thrust gate 44 which has a generally inclined surface 45 and a pair of side surfaces 46 which are affixed to the steering nozzle 26. When the reverse thrust bucket 33 is in its reverse thrust position, the lower end of the curved surface 34 of the reverse thrust bucket will mate with the inclined surface 45 and provide a continuous reverse flow path for the water exiting the steering nozzle 25 so as to generate the reverse thrust. Water is discharged through the discharge nozzle cut out 29 during this reverse operation.

It should be noted that the reverse thrust bucket will also experience an upward force which tends to cause one side of the hull to lift. If the reverse thrust bucket is shifted into its reverse thrust condition to cause an abrupt turn to be made, this lifting force will tend to act in the same direction as the turning force with obviously undesired results. However, since the pivot axes 27 are angularly disposed to the vertical, the upward force F as shown in FIG. 2 will have a lesser vertical component $F_V$ than its total force so that this lifting force will somewhat be reduced.

It should be readily apparent from the foregoing description that the described reverse thrust bucket construction permits good efficiency when operating in either the forward or the reverse drive modes, will preclude leakage when in either position, will facilitate smooth movement with minimum resistance to movement caused by water forces and is generally extremely effective. Of course, the foregoing description is that of a preferred embodiment of the invention and various changes and modifications may be made without departing from the spirit and scope of the invention, as defined by the appended claims.

I claim:

1. A reverse thrust arrangement for a water jet propulsion unit comprising a discharge nozzle having a discharge opening through which water from said jet propulsion unit is discharged, a reverse thrust bucket supported for movement relative to said discharge nozzle between a forward drive position generally above said discharge opening wherein the flow of water from said discharge opening is substantially unobstructed for establishing a forward drive mode and the flow of water through said reverse thrust bucket is substantially unrestricted by said thrust bucket and a reverse drive position wherein water flowing from said discharge opening is redirected for generating a reverse drive thrust, said reverse thrust bucket being defined by a first portion having a generally continuous and unobstructed arcuate surface adapted to be brought into facing relationship with said discharge opening for redirecting said water only when said reverse thrust bucket is in its reverse thrust position and a pair of side portions extending along opposite sides of said discharge nozzle, said first portion and said side portions defining a generally forwardly facing opening through which water may pass unobstructedly when said reverse thrust bucket is in its forward drive mode and for precluding any flow resistance against movement of said reverse thrust bucket, and means on said discharge nozzle for forming a seal with said arcuate surface and said side portions of said reverse thrust bucket when aid reverse thrust bucket is in its reverse drive position for precluding water leakage from between said reverse thrust bucket and the upper portion of said discharge nozzle.

2. A reverse thrust arrangement as set forth in claim 1 wherein the means on the discharge nozzle comprises a flange complementary in configuration to the configurations of the arcuate surface and side portions of the reverse thrust bucket when in its reverse thrust position.

3. A reverse thrust arrangement as set forth in claim 1 wherein the first portion arcuate surface terminates at the side portions and has no surface discontinuity in its curved surface that would provide any flow resistance.

4. A reverse thrust arrangement as set forth in claim 3 wherein the means on the discharge nozzle comprises a flange complementary in configuration to the configuration of the reverse thrust bucket when in its reverse thrust position.

5. A reverse thrust arrangement as set forth in claim 4 wherein the reverse thrust bucket is supported for pivotal movement on the discharge nozzle about a generally horizontally extending pivot axis.

6. A reverse thrust arrangement as set forth in claim 5 wherein the curvature of the first portion of the reverse thrust bucket is generated about the pivotal axis.

7. A reverse thrust arrangement as set forth in claim 6 wherein the pivotal axis is disposed below the center of the discharge opening.

8. A reverse thrust arrangement as set forth in claim 7 wherein the flange of the discharge nozzle has a generally rectangular configuration in rear elevation.

9. A reverse thrust arrangement as set forth in claim 1 wherein the lower portion of the discharge nozzle adjacent the discharge opening is formed with a cut out and further including a reverse thrust gate fixed to the discharge nozzle and cooperable by the curved surface of the first portion when the reverse thrust bucket is in its reverse thrust position for directing water flow downwardly and then forwardly to generate the reverse thrust.

10. A reverse thrust arrangement as set forth in claim 9 wherein the first portion arcuate surface terminates at the side portions and has no surface discontinuity in its curved surface that would provide any flow resistance.

11. A reverse thrust arrangement as set forth in claim 10 wherein the means on the discharge nozzle comprises a flange complementary in configuration to the configuration of the arcuate surface and side portions of the reverse thrust bucket when in its reverse thrust position.

12. A reverse thrust arrangement as set forth in claim 11 wherein the reverse thrust bucket is supported for pivotal movement on the discharge nozzle about a generally horizontally extending pivot axis.

13. A reverse thrust arrangement as set forth in claim 12 wherein the curvature of the first portion of the reverse thrust bucket is generated about the pivotal axis.

14. A reverse thrust arrangement as set forth in claim 13 wherein the pivotal axis is disposed below the center of the discharge opening.

15. A reverse thrust arrangement as set forth in claim 14 wherein the flange of the discharge nozzle has a generally rectangular configuration in rear elevation.

16. A reverse thrust arrangement as set forth in claim 1 wherein the discharge nozzle comprises a steering nozzle pivotally supported for movement about a generally vertical steering axis at the end of the jet propulsion unit for effecting steering of the associated watercraft.

17. A reverse thrust arrangement as set forth in claim 16 wherein the means on the discharge nozzle comprises a flange complementary in configuration to the configuration of the arcuate surface and side portions of the reverse thrust bucket when in its reverse thrust position.

18. A reverse thrust arrangement as set forth in claim 16 wherein the first portion arcuate surface terminates at the side portions and has no surface discontinuity in its curved surface that would provide any flow resistance.

19. A reverse thrust arrangement as set forth in claim 18 wherein the means on the discharge nozzle comprises a flange complementary in configuration to the configuration of the arcuate surface and side portions of the reverse thrust bucket when in its reverse thrust position.

20. A reverse thrust arrangement as set forth in claim 19 wherein the reverse thrust bucket is supported for pivotal movement on the discharge nozzle about a generally horizontally extending pivot axis.

21. A reverse thrust arrangement as set forth in claim 20 wherein the curvature of the first portion of the reverse thrust bucket is generated about the pivotal axis.

22. A reverse thrust arrangement as set forth in claim 21 wherein the pivotal axis is disposed below the center of the discharge opening.

23. A reverse thrust arrangement as set forth in claim 22 wherein the flange of the discharge nozzle has a generally rectangular configuration in rear elevation.

24. A reverse thrust arrangement as set forth in claim 16 wherein the lower portion of the discharge nozzle adjacent the discharge opening is formed with a cut out and further including a fixed reverse thrust gate fixed to the discharge nozzle and engageable by the curved surface of the first portion when the reverse thrust bucket is in its reverse thrust position for directing water flow downwardly and then forwardly to generate the reverse thrust.

25. A reverse thrust arrangement as set forth in claim 24 wherein the first portion arcuate surface terminates at the side portions and has no surface discontinuity in its curved surface that would provide any flow resistance.

26. A reverse thrust arrangement as set forth in claim 25 wherein the means on the discharge nozzle comprises a flange complementary in configuration to the configuration of the arcuate surface and side portions of the reverse thrust bucket when in its reverse thrust position.

27. A reverse thrust arrangement as set forth in claim 26 wherein the reverse thrust bucket is supported for pivotal movement on the discharge nozzle about a generally horizontally extending pivot axis.

28. A reverse thrust arrangement as set forth in claim 27 wherein the curvature of the first portion of the reverse thrust bucket is generated about the pivotal axis.

29. A reverse thrust arrangement as set forth in claim 28 wherein the pivotal axis is disposed below the center of the discharge opening.

30. A reverse thrust arrangement as set forth in claim 29 wherein the flange of the discharge nozzle has a generally rectangular configuration in rear elevation.

* * * * *